United States Patent [19]

McCaul

[11] 3,948,186

[45] Apr. 6, 1976

[54] OVERHEAD POWER AND FREE CONVEYOR SYSTEM

[75] Inventor: Edward W. McCaul, Bloomfield Hills, Mich.

[73] Assignee: Jervis B. Webb Company, Detroit, Mich.

[22] Filed: Apr. 24, 1975

[21] Appl. No.: 571,493

Related U.S. Application Data

[63] Continuation of Ser. No. 179,956, Sept. 13, 1971, abandoned.

[52] U.S. Cl. ..... 104/172 S; 104/96; 104/162

[51] Int. Cl.[2] ..... B61B 13/00; B61J 3/04

[58] Field of Search ..... 104/172 S, 89, 96, 102, 104/162, 165; 105/148

[56] References Cited

UNITED STATES PATENTS

| | | | |
|---|---|---|---|
| 3,451,352 | 6/1969 | Curry et al. | 104/172 S |
| 3,477,388 | 11/1969 | Klamp | 104/96 |
| 3,706,286 | 12/1972 | Ricaud et al. | 104/172 S |
| 3,742,861 | 7/1973 | Wilkinson | 104/172 S X |

*Primary Examiner*—Robert J. Spar
*Assistant Examiner*—Randolph A. Reese
*Attorney, Agent, or Firm*—Farley, Forster and Farley

[57] ABSTRACT

An overhead power and free conveyor system in which a carrier is propelled along a portion of the carrier track of the system in the conventional manner by a pusher on a driven chain engaging a driving dog on the carrier. The carrier is propelled along another portion of the carrier track of this system by a self-propelled tractor, with provision for transferring a carrier from one of these forms of propulsion to another. Preferably, the tractor travels on the carrier track when propelling a carrier or a train of carriers, which may be directly coupled to the tractor. Alternately, the tractor travels on the carrier track and pulls a tow bar, supported by a separate track, and equipped with a pusher engageable with the carrier driving dog.

14 Claims, 8 Drawing Figures

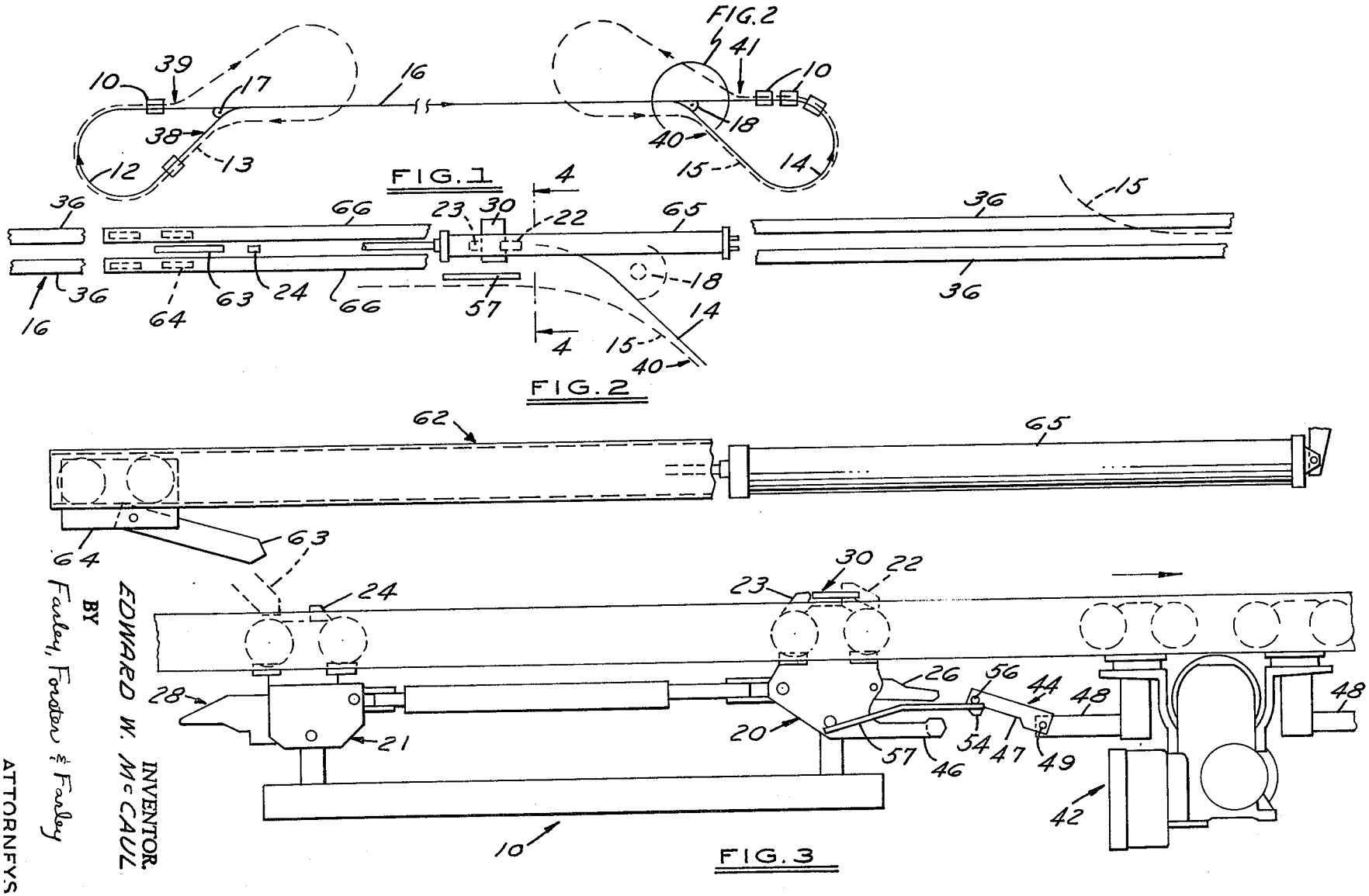
INVENTOR.
EDWARD W. McCAUL
BY
Farley, Forster & Farley
ATTORNEYS

INVENTOR.
EDWARD W. McCAUL
BY
Farley, Forster & Farley
ATTORNEYS

INVENTOR.
EDWARD W. McCAUL
BY
Farley, Forster & Farley

INVENTOR.
EDWARD W. McCAUL
BY
Farley, Forster & Farley

OVERHEAD POWER AND FREE CONVEYOR SYSTEM

This is a continuation of application Ser. No. 179,956, filed Sept. 13, 1971, now abandoned.

SUMMARY OF THE INVENTION

This invention relates to improvements in an overhead power and free conveyor system.

In the conventional overhead power and free conveyor, a carrier is propelled along a supporting track by a pusher which engages a driving dog on the carrier, the pusher being connected to an endless driven chain supported by trolleys which travel on a track adjacent to the carrier track. Carriers may be stopped at work stations, and accumulated, by disengaging the carrier driving dog from a pusher. Carriers may also be transferred from a pusher of one chain to a pusher of a separately driven chain in order to vary the spacing between successive carriers, or the speed at which carriers are propelled, or both, but carrier spacing and carrier speed depend upon the arrangement of pushers on a chain and the speed at which that chain is driven. In practice, there are limitations on the maximum length of a chain and on chain speed which make it impractical to convey carriers over a continuous carrier track layout where relatively long distances are involved between work stations or areas.

The present invention enables a carrier to be propelled along a portion of an overhead power and free system, by a self-propelled tractor which can be operated over a significantly higher speed range than a conventional chain equipped with carrier engaging pushers. The propulsion of a carrier can be transferred from a chain pusher to carrier engaging means connected to the self-propelled tractor, and transferred back to a chain pusher at the end of the portion of a system over which the self-propelled tractor operates. A plurality of carriers can be propelled by one tractor; also, carriers can be coupled together and propelled as a train, either by a tractor or by a chain pusher. These features make it possible to greatly increase the versatility of an overhead power and free conveyor system. For example, remotely located work processing areas can be integrated into a single system served by carriers operating on a continuous track network; empty carriers can be more expeditiously returned to a starting point in a system; and, carriers can be operated in groups where desirable.

According to the present invention, a self-propelled tractor is associated with a portion of the carrier supporting track of an overhead power and free conveyor system. Carrier engaging means are operatively connected to the self-propelled tractor and the system includes a station at which the propulsion of a carrier is transferred between a conventional chain pusher and the carrier engaging means of the tractor. Preferably, the self-propelled tractor travels on the carrier supporting track, and is provided with a coupling element releasably engageable with a coupling element on a carrier. These coupling elements may be disengaged where desired by a cam mounted adjacent to the carrier supporting track.

The carrier has a driving dog engageable by a chain pusher, and preferably includes releasing means, such as a lever, for moving the driving dog to a non-driving position relative to a chain pusher. When the coupling element on the carrier is engaged by the coupling element on the tractor, a cam device on the tractor operates the driving dog releasing means, moving the carrier driving dog to non-driving position. A coupling element and cam device can also be mounted on another carrier so that carriers may be coupled together, but in this case the coupling element is selectively operable so that the conventional accumulating action of the carrier driving dog releasing mechanism can be retained where desired. The transfer of a carrier from a chain pusher to propulsion by a tractor is attained by disengaging the carrier driving dog from the chain pusher and coupling the carrier to the tractor. The transfer of a carrier from propulsion by the tractor to propulsion by a chain pusher is attained by uncoupling the carrier from the tractor with the aid of a cam mounted along side of the carrier supporting track, stopping the carrier so as to allow the tractor to proceed, and feeding the carrier onto a branch track into a position where the carrier driving dog can be engaged by a chain pusher associated with such branch track.

Alternate arrangements are shown in the accompanying drawings and will hereinafter be described.

DESCRIPTION OF THE DRAWINGS

FIG. 1 is a schematic plan view of a conveyor system constructed in accordance with the invention;

FIG. 2 is a schematic plan view, on an enlarged scale, of the encircled portion of the system of Fig. 1 labelled "FIG. 2";

FIG. 3 is an enlarged elevation of a portion of the structure shown in FIG. 2, including a carrier and a self-propelled tractor being uncoupled therefrom;

DESCRIPTION OF THE PREFERRED EMBODIMENTS

Figure 4:
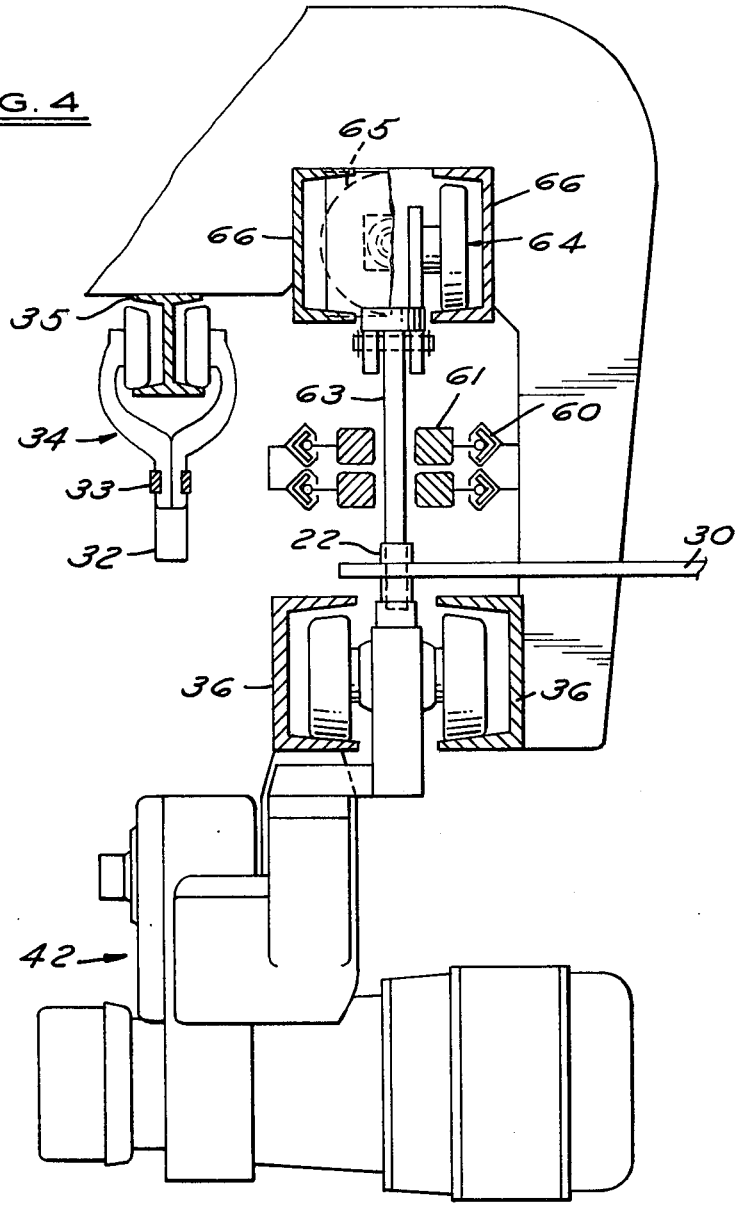
FIG. 4 is an enlarged sectional elevation, taken as indicated by the line 4—4 of FIG. 2.

In the power and free conveyor system schematically shown in FIG. 1, the solid lines represent a track which supports carriers 10 and the broken lines represent power lines, each including a track which supports an endless driven chain and pushers. The carrier supporting track includes a loop 12 at the left hand side of the view served by a power line 13, and a loop 14 at the right hand side of the view served by a power line 15. One of the loops 12 and 14, for example, may be an area where carriers are loaded, and the other an area where carriers are unloaded; and, these areas are assumed to be separated by a considerable distance. The loops are connected by a length of carrier supporting track 16 which extends between a switch 17 at the entrance to the loop 12 and a switch 18 at the entrance to the loop 14.

A typical carrier 10 is shown in FIG. 3, and includes a forward trolley 20 connected to a rear trolley 21, the forward trolley 20 having a main driving dog 22 and a holdback dog 23, the rear trolley having an auxiliary driving dog 24. Preferably, the main driving dog 22 is moveable to a non-driving position relative to a pusher by operation of a forwardly extending driving dog releasing lever 26 pivoted to the trolley 20. A further description of a trolley of this type may be found in U.S. Pat. No. 3,044,416, the driving dog releasing lever 26 of one carrier being operable by a cam 28 on the rear trolley 21 of a preceeding carrier to move the driving dog 22 to non-driving position. Alternately, the driving dog 22 may be moved to a non-driving position by a stop plate 30. Carriers of this type, including the arrangement of the holdback dog 23 and auxiliary driving dog 24 are further described in U.S. Pat. Nos. 3,229,645 and 3,314,377.

A carrier 10 is propelled along the loop portions 12 and 14 of the carrier track by the conventional arrangement of a pusher 32 (FIG. 4) connected to an endless chain 33 supported by trolleys 34 from a track 35, the track 35 of either of the power lines 13 or 15 being arranged in vertical alignment with the carrier supporting track where driving engagement is desired between the pusher 32 and the carrier driving dog 22. In FIG. 1, at the left hand carrier track loop 12, the track 35 of the power line 13 converges into such vertical alignment with the opposed channels 36 (FIG. 4) forming the carrier supporting track at a location approximately indicated by the reference 38, and diverges from such a relation at a location approximately indicated by the reference numeral 39. Similar areas of convergence and divergence of the power line with the carrier supporting track on the right hand loop 14 in FIG. 1 are indicated by the reference numerals 40 and 41, respectively.

A self-propelled tractor 42, shown in FIGS. 3 and 4, is associated with that portion of the carrier supporting track extending between the areas designated by the reference numerals 39 and 41, and in the construction of FIGS. 1–4 the self propelled tractor 42 travels on this portion of the carrier supporting track to propel loaded carriers from the loop 12 to the loop 14 and return empty carriers from the loop 14 to the loop 12. The tractor 42 is provided with carrier engaging means 44 operatively connected thereto, and the conveyor system includes stations at which the propulsion of a carrier is transferred between a chain pusher 32 and the carrier engaging means 44. These features will now be described in more detail.

Figure 6:
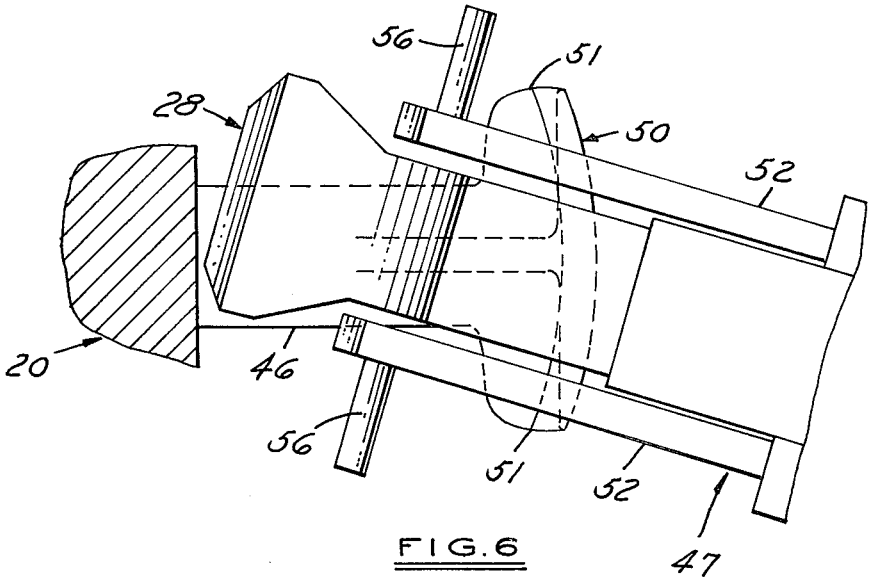
FIG. 6 is a plan view of the structure shown in FIG. 5, with the coupling elements being arranged in angular relation for clarity.

In the system of FIGS. 1–4, the carrier engaging means comprises a coupling element 46 fixed to the front trolley 20 of the carrier and a coupling element 47 connected to suitable structure 48 of the tractor 42 by a transverse pivot 49. The carrier coupling element 46 also serves as a bumper and is provided with a T-shaped forward end portion 50 (FIG. 6) having transversely projecting portions 51. The coupling element 47, as best shown in FIG. 6, includes a pair of transversely spaced members 52, which move in unison about the pivot 49, are adapted to straddle the coupling element 46 of the carrier, and are provided with hook like portions 54 engageable with the T-shaped end portions 51 of the coupling element 46. The coupling element 47 can be released from the coupling element 46 by engagement between a follower 56 provided on either or both of the members 52 and a cam 57 (FIG. 3) suitably mounted along side of the carrier track.

A station at which the propulsion of a carrier is transferred between a chain pusher 32 and the carrier engaging means 44 may be one where the transfer is from a chain pusher to the carrier engaging means or vice versa. In the former type and in the system of FIGS. 1–4, the driving dog 22 of a carrier is disengaged from the chain pusher which had been propelling it by diverging the chain supporting track from the carrier supporting track as at the area 39 or 41 in FIG. 1. A carrier stop 30 is also preferably provided at this transfer station so that carriers may accumulate to await transfer. Backing the tractor 42 into a waiting carrier at this transfer station causes the coupling elements 46 and 47 to automatically engage, and the carrier is then propellable by the tractor, power for the tractor being obtained from conventional conductor bars 60 (FIG. 4) through collector shoes 61 carried by the tractor. Various known arrangements enable the speed and direction of movement of the tractor 42 to be controlled, and hence have not been disclosed herein.

A station for transferring the propulsion of a carrier from the tractor 42 to a chain pusher 32 is shown in FIGS. 2 and 3 for the station at the entrance of a carrier to the loop 14. This station includes the switch 18 for diverting a carrier from the path of travel of the tractor 42 onto the entrance to the loop 14, together with the cam 57 for releasing the coupling element 47 of the tractor from the coupling element 46 of the carrier, a stop 30 for arresting movement of the carrier prior to the location of the switch 18 and subsequent to the releasing operation of the cam 57, and a feeder device 62 for advancing the carrier onto the branch track.

The feeder device 62 consists of a pusher 63 engageable with the auxiliary driving dog 24 of the carrier, and pivotally attached to a trolley 64 which is moveable along a track section above the carrier track 16 by a fluid pressure cylinder 65. The feeder track is composed of a pair of channel members 66, mounted as shown in FIG. 4.

As a carrier approaches this transfer station under propulsion by a tractor 42, the tractor coupling element 47 is released from the carrier coupling element 46 by operation of the cam 57 and follower 56, and forward movement of the carrier is arrested by engagement of the stop 30 with the carrier holdback dog 23. The tractor proceeds on to pick up any carrier waiting at the area 41. Then the switch 18 is thrown to branch line position and the feeder 62 is operated, moving the feeder pusher 63 into engagement with the carrier auxiliary dog 24, and advancing the carrier through the switch and into a position where the main driving dog 22 is engaged by a pusher 32 of the power line 15 which converges into driving relationship with the carrier supporting track 14 at the area 40.

As the loaded carrier is being advanced by the feeder mechanism 62 onto the loop 14, the tractor 42 proceeds to the transfer station at the area 41 and a coupling element 47 on the other end of the tractor engages an awaiting empty carrier. Movement of the tractor is then reversed and the empty carrier is taken along the carrier track portion 16 to the loading loop 12 where the empty carrier is uncoupled from the tractor and advanced through the switch 17 by an arrangement and feeder device such as shown in FIGS. 2 and 3 and described above.

Figure 5:
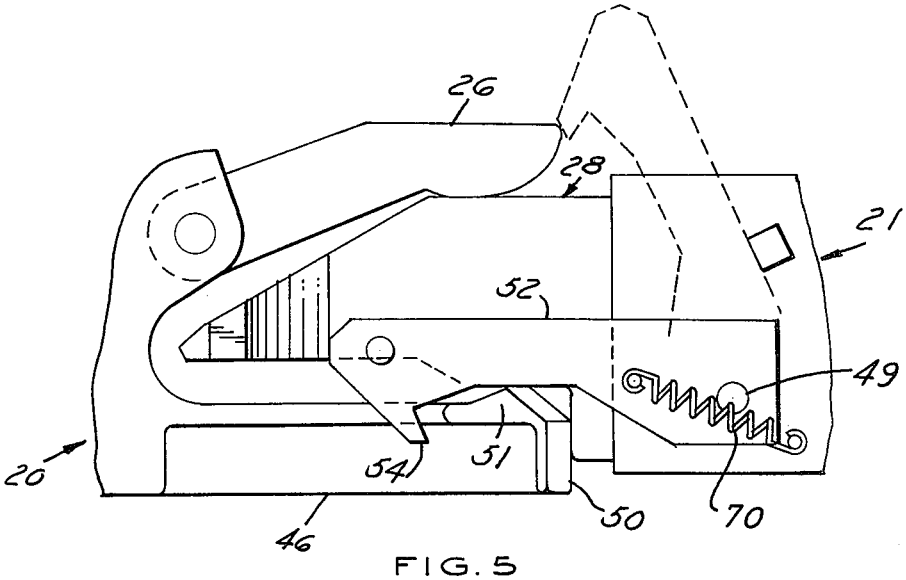
FIG. 5 is an enlarged detailed elevation showing coupling elements on a carrier and on another carrier.

Alternately, a plurality of carriers may be coupled to a tractor by equipping the carriers with coupling elements, as shown in FIGS. 5 and 6. Referring to FIG. 5, a pair of coupling members 52, such as previously described, are mounted on the rear trolley 21 of a carrier and function in conjunction with the cam 28 thereof which operates the driving dog releasing lever 26 on the leading trolley 20 of a following carrier, raising the lever 26 and thereby moving the driving dog 22 of the following carrier to non-driving position when the coupling elements 52 are engaged with the T-shaped end portion 51 of the following carrier bumper and coupling element 46. The coupling members 52 can be selectively rendered operable and non-operable with respect to the coupling element 46 so that when the coupling members 52 are non-operable, carriers can accumulate one behind another in the normal manner when travelling on a part of the system where propulsion of the carriers is by chain pushers. In the construction shown in FIG. 5, the coupling members 52 are connected to the body of the trolley by a spring 70 which is mounted in over-center relation to the pivot 49 on which the members 52 are mounted. A suitable cam (not shown) similar to coupling element releasing cam 57, but shaped to perform the function desired, can be mounted adjacent the carrier supporting track to move the coupling members 52 between the operable and non-operable positions thereof, as desired.

Preferably, the coupling element arrangement shown in FIGS. 5 and 6 and including the combination of the coupling members 52 and releasing cam 28 is also employed on the tractor 42, except that in this case there is no necessity for including any means, such as the spring 70, for selectively rendering the coupling elements operable and non-operable.

Figure 7:
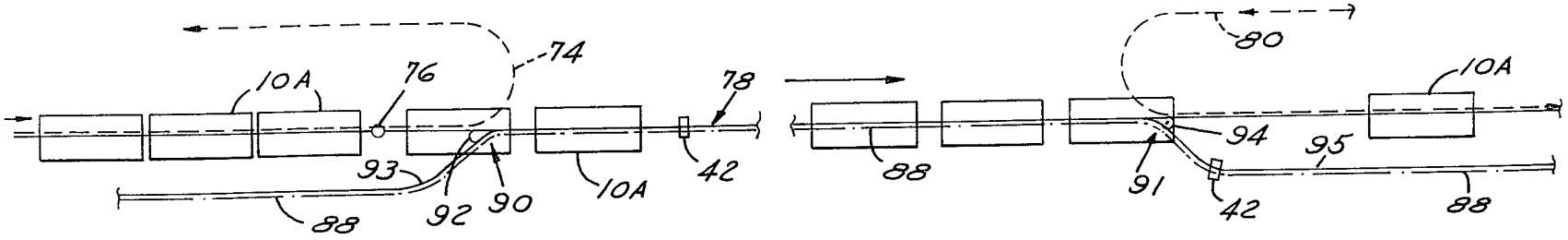
FIG. 7 is a schematic plan view of an alternate type of construction for a conveyor system of the invention; and, FIG. 8 is an elevation showing a group of carriers being propelled by a tractor in the system of FIG. 7.
Figure 8:
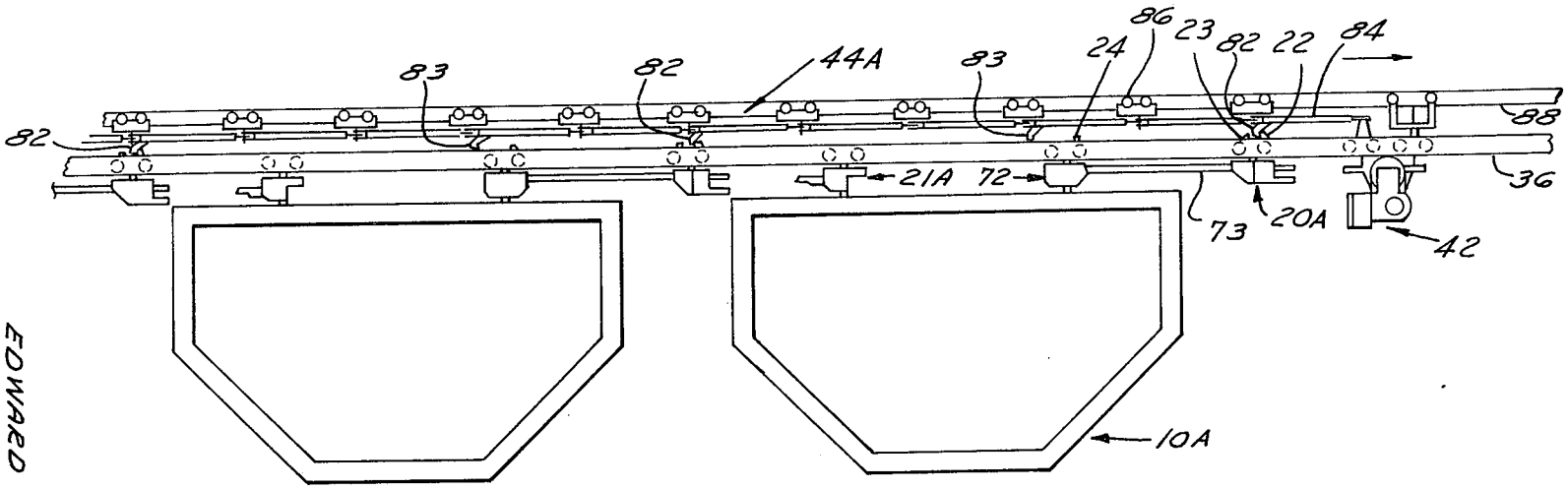

In the system of the invention, as illustrated in FIGS. 7 and 8, a carrier 10A includes a front towing trolley 20A, a rear trolley 21A, and an intermediate load carrying trolley 72 connected to the front trolley 20A by a towing link 73. The front trolley 20A is similar in construction to the trolley 20 previously described, and includes a main driving dog 22 and holdback dog 23. An auxiliary driving dog 24 is mounted on the intermediate trolley 72.

Carriers 10A, in the portion of the system shown in FIG. 7, are propelled at the left portion of this view by pushers of a power line 74 and accumulate behind a stop 76 to await transfer to the carrier engaging means generally designated 44A connected to a self-propelled tractor 42, for propulsion thereby along a carrier track portion 78 and transfer back to propulsion by pushers of a power line 80 shown at the right hand portion of this view.

The carrier engaging means 44A includes a plurality of pusher elements 82, each engageable with the main driving dog 22 of a carrier, and a plurality of supplementary pusher elements 83 each engageable with the auxiliary driving dog 24 of a carrier. The pusher elements 82 and 83 are connected to the tractor 42 by a series of tow bars 84, and the tow bars 84 and pusher elements 82 and 83 are supported by trolleys 86 travelling on a tow bar track 88 mounted above and adjacent to the carrier supporting track members 36. The tow bar track 88 is represented by a dot-dash line in FIG. 7.

The stations at which the propulsion of carrier 10A is transferred between a pusher of the power lines 74 or 80 and the carrier engaging means 44A are generally designated by the reference numerals 90 and 91 in FIG. 7. Each of the stations 90 and 91 include a junction between the carrier supporting track 78 and a branch track for the tractor 42. At the station 90, the junction is represented by a switch 92, the branch track for the tractor being represented by the solid line 93 and having a portion of the tow bar supporting track 88 arranged adjacent thereto. Similarly, the station 91 includes a switch 94 connecting the carrier supporting track 78 to a branch track 95 for the tractor, which branch track also has a portion of the tow bar supporting track 88 arranged adjacent thereto.

At the transfer station 90, a transfer operation proceeds as follows, assuming that the tractor 42 and carrier engaging means 44A are on the branch line 93, and a plurality of carriers 10A have accumulated behind the stop 76. When the stop 76 is released, the first waiting carrier is advanced by engagement of its driving dog 22 with a chain pusher of the power line 74 until this power line diverges from the carrier supporting track 78, as shown. A following chain pusher of the power line 74 then engages the auxiliary driving dog 24 of the carrier and the carrier is advanced into a position where the main driving dog thereof is engageable by a pusher element 82 connected to the tractor 42 which is moved ahead through the switch 90 onto the carrier supporting track to produce this engagement, and the tractor and first carrier stop for the next carrier. Other waiting carriers are successively advanced by the power line 74 in a similar manner and transferred to pusher elements 82 connected to the tractor by successive forward movements thereof until a group of carriers 10A are coupled to the carrier engaging means 44A. The tractor propels this group of carriers to the transfer station 91.

At the transfer station 91, the switch 94 is thrown to divert the arriving tractor 42 onto the branch line 95 and is then returned to main line position so that the front trolley 20A of the first carrier is not diverted to the branch line. This front trolley 20A, however, looses engagement with the pusher element 82 of the tractor, and then the auxiliary driving dog 24 of the carrier is engaged by the supplementary pusher element 83 which is connected to the tractor in trailing relation with the auxiliary driving dog 24. The supplementary pusher element 83 then propels the carrier forward to a position where the main driving dog 22 of the carrier is engageable by a pusher of the power line 80, and all successive carriers in the group are transferred to pushers of the power line 80 in like manner. After the transfer operation has been completed at the station 91, the tractor is reversed and returned back to the branch line 93 to pick up the next group of carriers which have accumulated behind the stop 76.

The foregoing is considered to be descriptive of only a few of the possible features and embodiments of a conveyor system incorporating the invention.

I claim:

1. In a conveyor system including a carrier track; a plurality of carriers supported thereon; means for propelling said carriers along one portion of said carrier track comprising a chain track adjacent to said carrier track, an endless driven chain supported by said chain track, pushers carried by said chain and a driving dog on each carrier engageable by one of said pushers; a self-propelled tractor for propelling said carriers along another portion of the carrier track; and stations at which the propulsion of a carrier is transferrable between said propelling means and said tractor; the improvement wherein said tractor is supported by and travels on said other portion of the carrier track, releasable coupling elements are provided on said tractor and carriers for the propulsion of at least one of said carriers by said tractor, and at least one of said stations includes a switch in said other portion of the carrier track, and separate tracks for said carriers and said tractor selectively connectable with said other portion of the carrier track by said switch.

2. A conveyor system according to claim 1 wherein said one station includes said carrier propelling means adjacent to said separate carrier track, means for releasing said coupling elements, and a feeder device for advancing said carriers on to said separate carrier track and into a position for engagement by said carrier propelling means.

3. A conveyor system according to claim 1 including releasable coupling elements provided on the carriers whereby said tractor can propel a plurality of carriers.

4. A conveyor system according to claim 3 further including means for selectively rendering the coupling element of one carrier operable and non-operable with respect to the coupling element of another carrier.

5. A conveyor system according to claim 4 further including cam means on one carrier operable to disengage the driving dog of another carrier from a chain pusher when the coupling elements of such two carriers are in engagement.

6. A conveyor system according to claim 1 wherein the releasable coupling elements include a fixedly mounted element and a moveably mounted element, one of said elements being mounted on the carrier and the other on the self-propelled tractor.

7. A conveyor system according to claim 6 wherein a follower member is operatively connected to the moveable coupling element, and a cam member is mounted adjacent the carrier supporting track, said cam member being engageable by the follower member to release the moveable coupling element from the fixedly mounted coupling element.

8. A conveyor system according to claim 1 wherein the releasable coupling element includes a member fixedly mounted on the carrier and including laterally projecting portions, and a pair of coupling members pivotally mounted on the tractor and adapted to engage said laterally projecting portions.

9. A conveyor system according to claim 8 wherein said pair of coupling members include a follower connected thereto, and a cam mounted adjacent the carrier track, the cam being engageable by the follower to move the coupling members to released position.

10. A conveyor system according to claim 1 wherein the carrier driving dog is moveable to a disengaged position relative to a pusher by driving dog releasing means mounted on the carrier, and means on the tractor for operating the driving dog releasing means.

11. A conveyor system according to claim 1 wherein the carrier includes a driving dog releasing lever capable of moving the driving dog to a disengaged position relative to a pusher, and the self-propelled tractor is provided with a cam associated with the coupling element on the tractor for operating the driving releasing lever on the carrier.

12. A conveyor system according to claim 1 wherein the releasable coupling elements comprise a fixed bumper on the carrier having a T-shaped forward end portion and a pair of moveable coupling members pivotally mounted on the self-propelled tractor adapted to straddle the carrier bumper and engage the T-shaped forward end portion thereof, a driving dog releasing lever mounted on the carrier and adapted to move the carrier driving dog to a disengaged position relative to a pusher, and a cam member mounted on the tractor between said pair of moveable coupling elements, the cam member being adapted to move the driving dog releasing lever and carrier driving dog to disengaged position when the coupling members on the self-propelled tractor are engaged with the T-shaped end portion of the carrier bumper.

13. A conveyor system according to claim 1 wherein said releasable coupling elements comprise a pusher element engageable with the carrier, a tow bar connecting the pusher element to the tractor, and a tow bar track mounted adjacent to the carrier track for supporting the pusher element and tow bar.

14. A conveyor system according to claim 13 wherein said releasable coupling elements include a plurality of tow bars and longitudinally spaced pusher elements, each pusher element being engageable with a carrier whereby a plurality of carriers may be propelled by the tractor.

* * * * *